US006766918B1

(12) United States Patent
Bogdanovich

(10) Patent No.: US 6,766,918 B1
(45) Date of Patent: Jul. 27, 2004

(54) STORAGE CONTAINER WITH CAPTIVE LID

(76) Inventor: Ron Bogdanovich, 103 Shadywood, Irvine, CA (US) 92620

( * ) Notice: Subject to any disclaimer, the term of this patent is extended or adjusted under 35 U.S.C. 154(b) by 0 days.

(21) Appl. No.: 10/336,216

(22) Filed: Jan. 3, 2003

(51) Int. Cl.[7] ..... B65D 43/16
(52) U.S. Cl. ..... 220/375; 220/843
(58) Field of Search ..... 220/375, 836, 220/841, 843, 845

(56) References Cited

U.S. PATENT DOCUMENTS

| | | | | |
|---|---|---|---|---|
| 715,399 | A | | 12/1902 | Low |
| 1,232,134 | A | * | 7/1917 | Watson |
| 1,234,189 | A | | 7/1917 | Macmillan |
| 1,406,683 | A | * | 2/1922 | Regan |
| 1,513,921 | A | | 11/1924 | Menefee |
| 1,662,189 | A | * | 3/1928 | Hyatt |
| 2,155,329 | A | | 4/1939 | Perdue |
| 2,547,353 | A | | 4/1951 | Wiinikka |
| 2,581,849 | A | | 1/1952 | Fisch |
| 2,704,100 | A | | 3/1955 | Freeman |
| 3,145,872 | A | | 8/1964 | Hayes |
| 3,383,009 | A | * | 5/1968 | Weikert |
| D228,887 | S | | 10/1973 | Gedell |
| 4,194,657 | A | * | 3/1980 | Thor |
| 4,339,056 | A | | 7/1982 | Berkstresser, Jr. et al. |
| 4,934,547 | A | | 6/1990 | Mayes et al. |
| 5,012,941 | A | | 5/1991 | Abrams et al. |
| 5,044,512 | A | | 9/1991 | Giancaspro et al. |
| 6,164,482 | A | | 12/2000 | Araki et al. |
| 6,227,399 | B1 | | 5/2001 | Angus et al. |
| 6,332,553 | B1 | | 12/2001 | Yamada et al. |

* cited by examiner

*Primary Examiner*—John A. Ricci
(74) *Attorney, Agent, or Firm*—Gene Scott-Patent Law & Venture Group

(57) ABSTRACT

A storage container apparatus comprises a storage portion having a bottom panel, and integral with, and extending upwardly from the bottom panel, a continuous peripheral storage portion side wall terminating with an upwardly facing rim. Downwardly spaced from the rim is an outwardly extending flange. A cover portion has a top panel, and integral with it and extending downwardly a continuous peripheral side wall terminating with an outwardly extending flange. The two flanges lie in mutual contact when the cover portion is in place over the storage portion. One or more circular wire rings fitted loosely through corresponding holes in the flanges and the rings are of such diameter as to enable the cover portion to be placed to one side of the storage portion without overlap of the respective flanges.

6 Claims, 2 Drawing Sheets

STORAGE CONTAINER WITH CAPTIVE LID

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to food storage containers and more particularly to such a container with means for capturing a removable lid so that the lid and container proper cannot become separated.

2. Description of Related Art

The following art defines the present state of this field:

Gedell, U.S. Des. Pat. No. 228,887 describes a combined can sealing plug and retainer ring design.

Low, U.S. Pat. No. 715,399 describes a means for retaining sealing-caps with vessels, the combination consisting of the cap provided with a circumferential enlargement at its top, and an outwardly trending flange at its bottom; a band encircling said cap, and free to move circumferentially and longitudinally between said enlargement and said flange; and provided with ears to receive an attachment, by which said band is secured to the said cap; a flexible attachment connected at one end with the said ears of said band and at the other connected to a band located upon the neck of a vessel between beads formed upon said neck, the said neck-band being closed upon the said neck by passing the end of the said al,tachment through ears upon the ends of said neck-band, and a vessel-neck having channel formed between beads on said neck, all constructed, arranged and combined to operate, substantially as specified, whereby the said neck-band is restricted as to vertical motion and the capband is unrestricted in its movements upon the said cap.

MacMillan, U.S. Pat. No. 1,234,189 describes a liquid-tight receptacle comprising a can provided with a neck, the upper edge of which is rolled to form an external bead, said beaded upper edge being of less diater than the body portion of said neck, a flexible moisture seal extending across the mount of the can and having its edges terminating below said external bend, a sealing band confining the edge of said seal beneath said bead, and a cover having a flat central portion extending extirely over the mouth of the can in contact with said moisture seal, said cover being formed with a depending annular flange enclosing the moisture seal and sealing band and closely fitting the body portion of the can neck below said bead and sealing band.

Menefee, U.S. Pat. No. 1,513,921 describes the combination with a container and a cover, of a flexible loop-shaped member passing through registering openings in the cover and container to maintain them in operative relation and adapted to be drawn upwardly through the openings and held taut while putting the cover in place, a staple member rigidly mounted upon said cover and extending downwardly and outwardly from the cover for extending through a slot in the container, and means for engaging the protruding end of the staple whereby the cover may be locked upon said container.

Perdue, U.S. Pat. No. 2,155,329 describes a receptacle having a discharge neck and a cap adapted to be removably secured over the neck, attaching means for said cap comprising a band of stretchable material having each end enlarged to form a flat tab, each of said tabs having an opening therethrough, one of said tabs being stretched for the reception of said neck and the other tab being stretched over and securing the cap in the opening thereof, the said cap and neck being tightly secured to the tab by the contraction of the same thereabout whereby the cap and neck are held against turning independently of the attached tabs and the said band being of sufficient length to permit the cap to be turned on and for connection with the neck of the receptacle.

Wiinikka, U.S. Pat. No. 2,547,353 describes the combination with the neck of a container of a cap for the neck, and connecting means between the cap and neck and including a guide carried by the neck, and a connector carried by the cap and slidably engaged with the guide, said connector including a tongue projecting laterally from the surface of the connector and resting on an edge of the neck to support the cap in an elevated position when removed from the neck.

Fisch, U.S. Pat. No. 2,581,849 describes a container having a threaded neck including an upper and a lower part and a cap adapted for engagement with said threaded neck; a flexible non-metallic connector device made from a single peice of a tubular body cut so as to provide two co-axilly arranged and normally spaced apart rings and a strap interconnecting said rings; one of said rings being adapted for position at the lower end of said threaded neck and for rotation thereabout, the other ring being adapted for frictional and firm engagement with said cap, said strap being of such length that in engagement position of said cap on said threaded neck said strap projects laterally beyond said rings whereby upon disengagement of said cap from said upper part of said threaded neck said cap will be springedly removed from said threaded neck by said strap and securely held by the latter on said container.

Freeman, U.S. Pat. No. 2,704,100 describes a container of rubber or the like having a neck provided with a passageway extending longitudinally thereof between the inner and outer surfaces of the neck, said passageway opening at the upper rim of the neck, said neck having an opening is the outer surface thereof beneath the rim thereof communicating with and forming part of the lower end of said passageway and providing a throughway from the rim of the, neck to the opening in the outer surface of the neck, a closure for said container, and a connecting member integral with the closure and extending down into the passageway into the opening in the outer surface of the neck.

Hayes, U.S. Pat. No. 3,145,872 describes a captive closure and nozzle assembly for a container comprising, a nozzle having vertically spaced external locking beads with the upper bead of lesser diameter than the lower bead, a closure including a cap and an annular holding ring permanently hingedly secured thereto, said cap having a depending annular skirt provided with locking shoulders on both the interior and exterior peripheries thereof, said holding ring having a pair of vertically spaced inwardly facing locking shoulders with the upper shoulder of greater diameter than the lower shoulder, said ring upper shoulder being detachably interengageable with said cap skirt exterior shoulder to facilitate unit handling of said closure prior to and during application thereof to said nozzle, said cap skirt interior shoulder being detachably interengageable with said upper nozzle bead to dispose said cap in sealing relation to said nozzle, and said ring lower shoulder being lockingly interengageable with said greater diameter lower nozzle bead when said ring upper shoulder is detached from said cap skirt exterior shoulder following engagement of said cap skirt interior shoulder with said upper nozzle bead, to thereby lock said closure to said nozzle and prevent loss thereof.

Berkstresser, Jr. et al., U.S. Pat. No. 4,339,056 describes a mechanism for tethering a removable cover to a container so that the cover does not become lost therefrom; the mechanism consisting of a flexible elongated strap which at one end includes a means for connecting to the cover, and which at the other end has means for connection to the container.

Mayes et al., U.S. Pat. No. 4,934,547 describes a specimen collection apparatus particularly useful for urine samples is disclosed the apparatus includes a container or beaker and a screw on self-locking top that cannot be removed without damage either to the top or the beaker.

Abrams et al., U.S. Pat. No. 5,012,941 describes a tamper-proof container and cap assembly including apertured flanges disposed on the container and cap, the apertures of which become substantially aligned when the cap is inserted onto the container. Integrally molded with one of the flanges is a locking strip designed for one-way passage through the aligned holes, whereby removal of the strip is possible only by permanent destruction thereof. Structure may be provided for preventing relative lateral movement between the flanges.

Giancaspro et al., U.S. Pat. No. 5,044,512 describes a sport bottle including a container for a liquid and a cover which seals to the container and which includes an aperture through which a straw extends. The straw extends outwardly from the cover to allow the user to drink from the container. A flexible handle element is secured to the cover and is disposed over the straw to allow the user to hold both the container and the straw. The handle element includes a cap for the straw so that the straw may be covered or closed when the sports bottle is not being used for drinking purposes. The cap prevents the liquid from sloshing out of the bottle and also prevents dirt, or the like, from entering through the straw and keeps the end of the straw or the portion of the straw which contacts the users lips, from accumulating dust, dirt, and the like.

Araki et al., U.S. Pat. No. 6,164,482 describes a string-attached cap in which one end of an elongated coupling member is connected to a capping member, the capping member is formed of an electroconductive resin, and the coupling member is also formed of an electroconductive resin which is flexible.

Angus et al., U.S. Pat. No. 6,227,399 describes a tamper-evident fastening assembly for an outlet of a conduit, including a closure member for covering the outlet of the conduit, a strap extending from the closure member, and first and second fasteners connected to the closure member. The first fastener secures a first portion of the strap to the conduit by forming a first loop. The second fastener secures a second portion of the strap to the closure member by forming a second loop. Removal of the closure member from the outlet breaks the second loop but leaves the first loop intact on the conduit.

Yamada et al., U.S. Pat. No. 6,332,553 describes an annular groove that is formed in a cap body of a cap. An elongated coupling member has a ring part formed integrally therewith, and is coupled to the cap as the ring part is engaged in the annular groove. The cap and the coupling member are each formed of electroconductive resin, and the surface resistance from the cap to the vehicle is set to be greater than or equal to 1.times.10.sup.12.OMEGA. and less than 5.30.times.10.sup.12.OMEGA. Hence, when the human body is brought into contact with the cap, static electricity in the human body is discharged to the vehicle side, and no shock is imparted to the human body. In addition, the amount of residual charge also declines without causing secondary spark discharge.

The prior art teaches specimen collection containers with non-removable covers; a sports bottle with a cover which seals to the container; a tamper evident fastener; a cap holder for bottles and tubes; closures for bottles and cans; a milk can with attached cover; attachments for caps; tamper proof container and cap; captive caps; and string attached caps, but does not teach a cover attached to the container by a ring such that the cover may be easily moved laterally to expose the interior of the container or move to be fully laid open. The present invention fulfills these needs and provides further related advantages as described in the following summary.

SUMMARY OF THE INVENTION

The present invention teaches certain benefits in construction and use which give rise to the objectives described below.

A storage container apparatus comprises a bottom storage portion having a bottom panel, and integral with, and extending upwardly from the bottom panel, a continuous peripheral storage portion side wall terminating with an upwardly facing rim. Downwardly spaced from the rim is an outwardly extending flange. A top cover portion has a top panel, and integral with it, and extending downwardly a continuous peripheral side wall terminating with an outwardly extending flange. The two flanges lie in mutual adjacency when the cover portion is in place over the storage portion with the cover sealing the bottom storage portion. One or more circular rings are fitted loosely through corresponding clearance holes in the flanges. The rings are of such diameter as to enable the cover portion to be dislodged above the storage portion and further enable the cover portion to be turned like the page in a ring binder to one side of the storage portion without the respective flanges overlapping. It should be noted that the rings provide three important advantages to the present invention: first, they prevent the cover and container portions from being separated; second, they guide the positioning of the cover with respect to the container portion in opening and closing the container portion; finally, they do not influence how the cover lies when it is removed from the container and placed on a dishwasher shelf. It should be noted that more tenuous connectors, such as flexible cords and bead type chains, when used to connect the cover and container, do not perform the job of guiding the cover on and off the container, and less tenuous connectors, such as flexible hinges, lanyards and such, do not permit the cover to be relatively free of the container so that its position in the dishwasher is unaffected by the connector, i.e., plastic memory positioning, etc. It has been found through extensive testing that one or two rings of the size and type used in the present invention provides a novel enablement ideally suitable for the control of the cover to the right extent.

A primary objective of the present invention is to provide an apparatus and method of use of such apparatus that provides advantages not taught by the prior art.

Another objective is to provide such an invention capable of storing items in a sealed space.

A further objective is to provide such an invention capable of full removal of a cover portion without the possibility of the cover being separated from a container portion to which it is attached.

A further objective is to provide such an invention capable of moving the cover portion to one side of the container portion.

A still yet objective is to provide such an invention with the ability to fully disconnect the cover portion from the storage portion for replacement.

A final objective is to provide such an invention with the storage portion and the cover portion fully independent; each of the other, with the cover portion capable of being rotated from a position sealing the storage portion, to a position to one side of the storage portion as with a page in a book.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least two of its preferred embodiments, which are further defined in detail in the following description.

Figure 1:
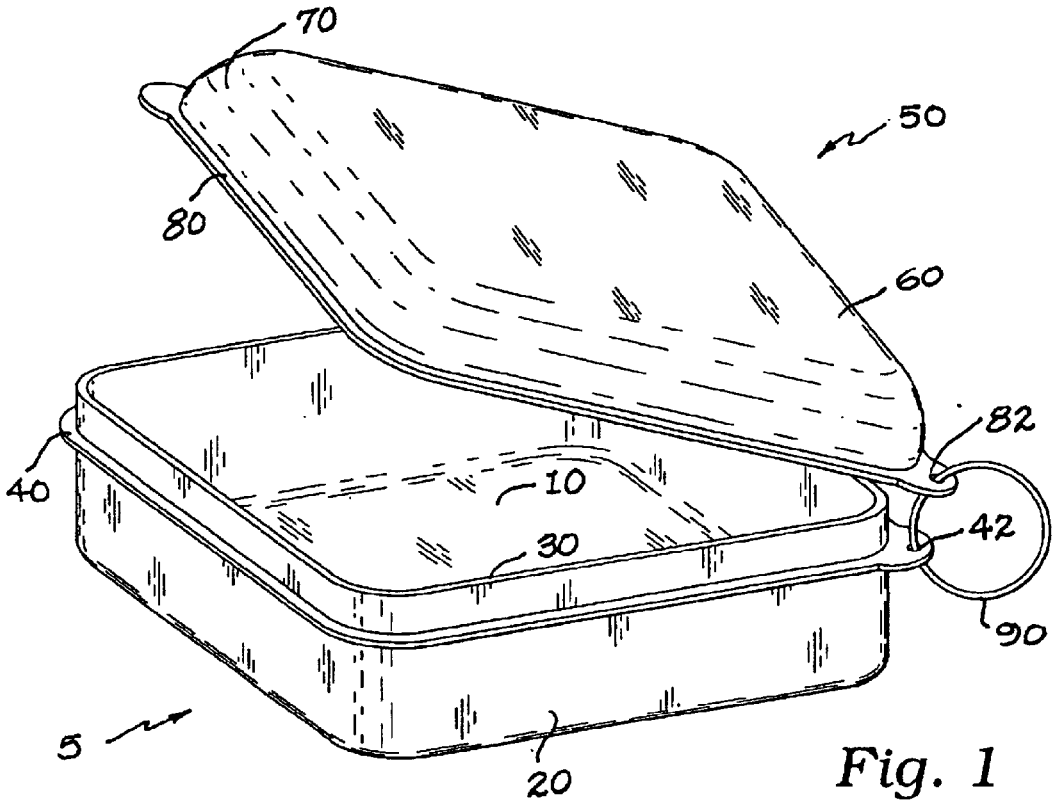
FIG. 1 is a perspective view of a preferred embodiment of the invention with cover of the invention shown ajar.
Figure 2:
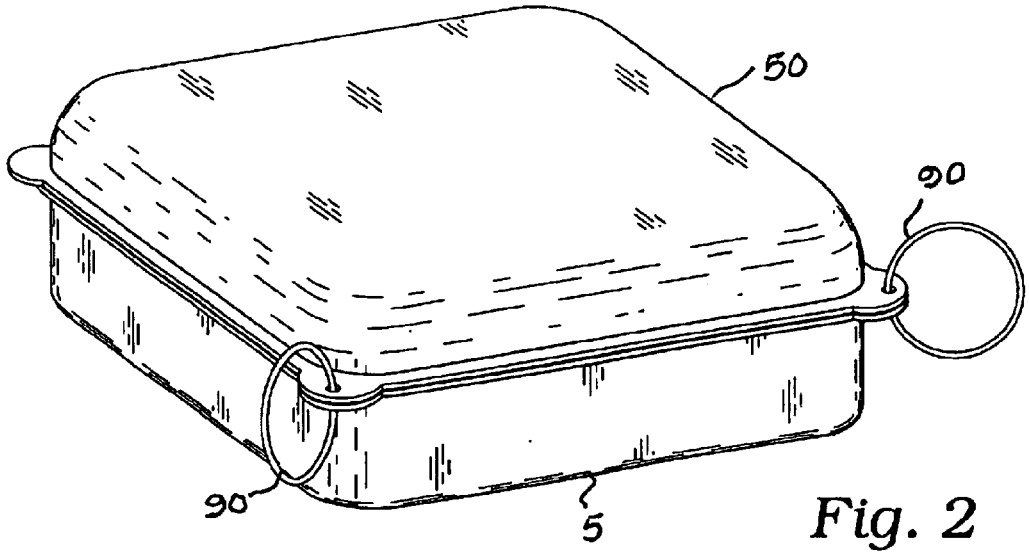
FIG. 2 is a perspective view of a further preferred embodiment thereof.
Figure 3:
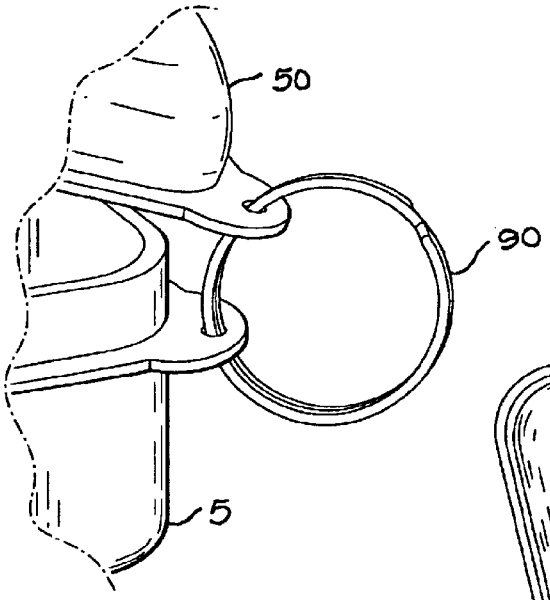
FIG. 3 is a partial perspective view of a split ring engagement thereof.
Figure 4:
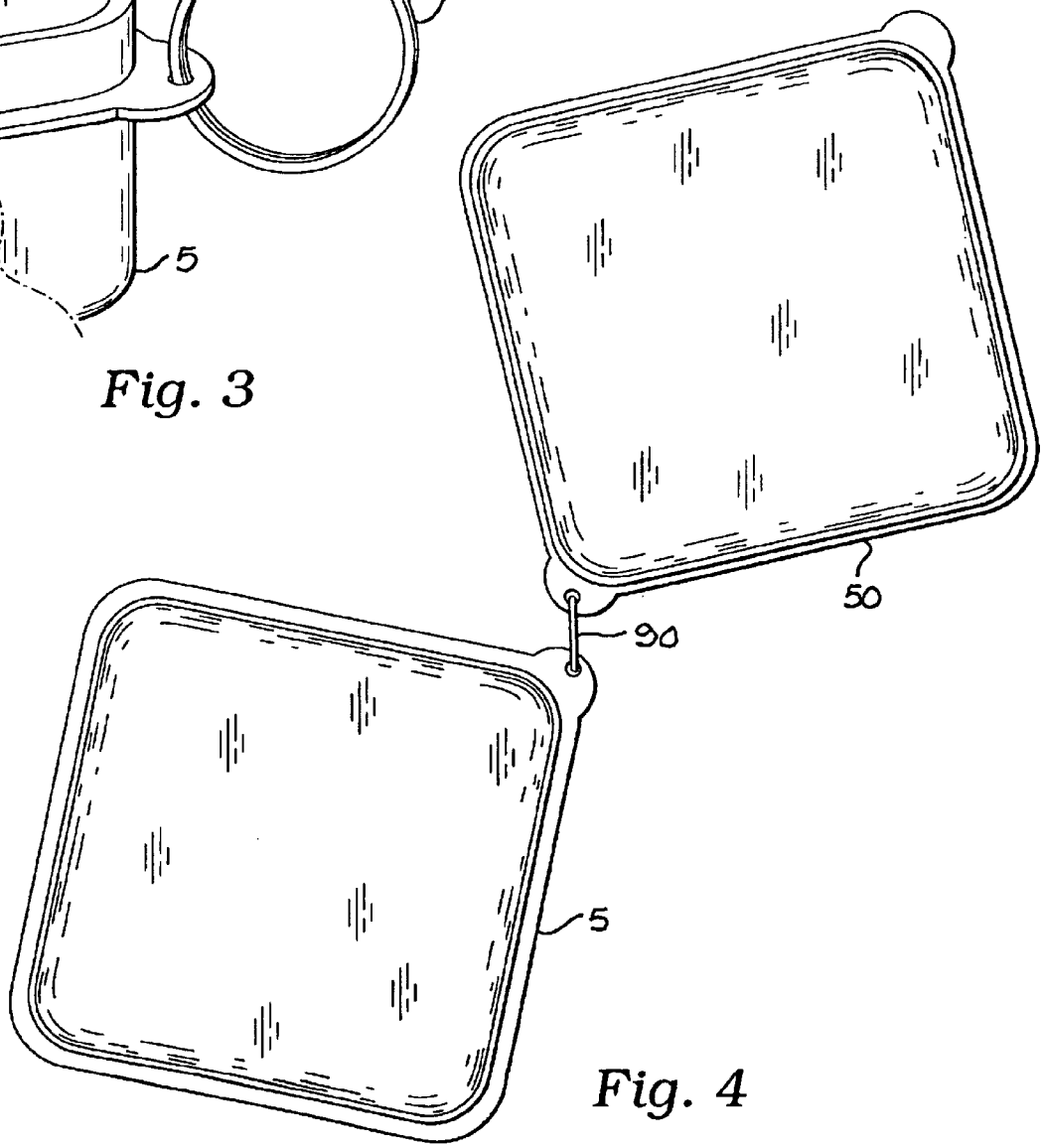
FIG. 4 is a plan view thereof laid fully open.

The present invention is a storage container apparatus comprising, in a first embodiment shown in FIG. 1, a storage portion 5 having a bottom panel 10, and integral with, and extending upwardly from the bottom panel 10, a continuous peripheral storage portion side wall 20 terminating with a top, upwardly facing rim 30; and downwardly spaced from the rim 30, an outwardly extending storage portion flange 40. The invention further comprises a cover portion 50 providing a top panel 60, and integral with the top panel 60 and extending downwardly from it, a continuous peripheral cover portion side wall 70 having an outwardly extending cover flange 80. The cover flange 80 and the storage flange 40 are in mutual adjacency or contact when the cover portion 50 is in place over the storage portion 5 for sealing it. The storage and cover portions are preferably injection molded plastic parts and may be transparent or opaque as desired. Finally, the invention further comprises one or more circular rings 90; preferably, one such ring 90, as shown in FIGS. 1 and 4 or two such rings 90, as shown in FIG. 2, loosely fitted through corresponding clearance holes 42 and 82 in the storage portion flange 40 and the cover portion flange 80 respectively. The rings 90 are preferably of such diameter as to enable the cover portion 50 to be lifted fully off the storage portion 5 so that the cover portion 50 is clear of the storage portion 5 and thus may be rotated laterally to one side of the storage portion momentarily for visibility into the storage portion 5, and also that it may be easily rotated around the ring(s) 90 so as to be placed in the same plane as the storage portion 5 without overlap of the respective flanges 40, 80. This assures that the entire surfaces of both container and cover portions are exposed for thorough cleaning and is a novel aspect of the invention. This is as shown in FIG. 4. The rings 90 may be continuous and integral as shown in FIGS. 1, 2 and 4, or they may be continuous and split as shown in FIG. 3. In the latter case, the cover portion 50 is able to be removed or replaced. The rings 90 are large enough to be used for hanging the storage and cover portions of the container on a hook or nail (not shown). The important novel aspect of the present invention is that the ring(s) 90 are not able to influence the positions of the cover and the storage portions 50, 5, because of the clearance holes 42, 82.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A storage container apparatus comprising: a storage portion having a bottom panel, and integral with, and extending upwardly from the bottom panel, a continuous peripheral storage portion side wall terminating with a top, upwardly facing, rim, and downwardly spaced from the rim, an outwardly extending storage portion flange; a cover portion having a top panel, and integral with the top panel, and extending downwardly from the top panel, a continuous peripheral side wall terminating with an outwardly extending cover portion flange; the cover portion flange and the storage portion flange laying in mutual adjacency when the cover portion is in place over the storage portion; and a circular flexible continuous ring fitted loosely through corresponding clearance holes in the storage and cover portions flanges, the ring of such diameter as to enable the cover portion to be removed from the container portion and rotated around the ring so as to be placed to one side in approximately the same plane as the storage portion, and spaced apart from the storage portion.

2. The apparatus of claim 1 wherein the ring is continuous and unbroken.

3. The apparatus of claim 1 wherein the ring is continuous and split.

4. A storage container apparatus comprising: a storage portion having a bottom panel, and integral with, and extending upwardly from the bottom panel, a continuous peripheral storage portion side wall terminating with a top, upwardly facing, rim, and downwardly spaced from the rim, an outwardly extending storage portion flange; a cover portion having a top panel, and integral with the top panel, and extending downwardly from the top panel, a continuous peripheral side wall terminating with an outwardly extending cover portion flange; the cover and storage portions flanges laying in mutual adjacency when the cover portion is in place over the storage portion; and a pair of circular flexible continuous rings fitted loosely through corresponding clearance holes in the storage and cover portions flanges, the rings of such diameter and placement as to enable the cover portion to be removed from the container portion and rotated around the ring so as to be placed to one side in approximately the same plane as the storage portion, and spaced apart from the storage portion.

5. The apparatus of claim 4 wherein at least one of the rings is continuous and unbroken.

6. The apparatus of claim 4 wherein at least one of the rings is continuous and split.

* * * * *